US006485104B1

(12) United States Patent
Keller

(10) Patent No.: US 6,485,104 B1
(45) Date of Patent: Nov. 26, 2002

(54) CUTTING TOOL ASSEMBLY WITH REPLACEABLE SPRAY NOZZLE HOUSING

(75) Inventor: Donald E. Keller, Bedford, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 09/718,676

(22) Filed: Nov. 22, 2000

(51) Int. Cl.[7] ..... E21C 35/187
(52) U.S. Cl. ..... 299/81.3; 299/81.1; 175/424
(58) Field of Search ..... 175/424; 299/81.1, 299/81.3, 102, 104

(56) References Cited

U.S. PATENT DOCUMENTS

| | | | | |
|---|---|---|---|---|
| 4,333,687 A | | 6/1982 | Barnstorf | |
| 4,705,321 A | * | 11/1987 | Hedlund | 299/81.3 |
| 4,978,173 A | * | 12/1990 | Rothkegel | 299/106 |
| 5,234,258 A | | 8/1993 | Komotzki | |
| 5,378,048 A | | 1/1995 | Parrott | |
| 5,392,870 A | | 2/1995 | Clapham et al. | 175/427 |
| 5,498,069 A | | 3/1996 | Siebenhofer et al. | 299/81.3 |
| 6,247,759 B1 | * | 6/2001 | Montgomery et al. | 175/424 |
| 6,257,672 B1 | * | 7/2001 | Parrott | 239/600 |

FOREIGN PATENT DOCUMENTS

GB 2092205 A 8/1982

OTHER PUBLICATIONS

Kennametal Inc., The Mining Tool Authority, 2000.

* cited by examiner

*Primary Examiner*—David Bagnell
*Assistant Examiner*—Brian Halford
(74) *Attorney, Agent, or Firm*—Melvin P. Weldon

(57) ABSTRACT

A cutting tool assembly (10) includes a support block (12), a replaceable spray nozzle housing, a liquid seal tight insert ring and first and second fluid passages. The first fluid and second fluid passage has an axis and extends between the concealable outer surface portion (22) and a first (20) surface portion of the support block. The first and second fluid passages are substantially straight between first and second outer surfaces so as to permit a drill to be inserted into first and second fluid passage for cleaning. The cutting tool assembly (10) also includes an exterior replaceable spray nozzle housing (14) on the support block having a cylindrical inlet portion (38) that extends into the first fluid passage such that the spray nozzle housing (14) is in fluid communication with the first fluid passage. A separate insert ring independent of a tool holding wear protective sleeve is press fit into the rear portion of the support block and forms an annular flow chamber section of the first fluid passage. The insert ring may be readily removed in the field to permit cleaning of the first fluid passage.

34 Claims, 2 Drawing Sheets

CUTTING TOOL ASSEMBLY WITH REPLACEABLE SPRAY NOZZLE HOUSING

TECHNICAL FIELD

The invention relates to a cutting tool assembly having a replaceable spray nozzle housing.

BACKGROUND ART

Cutting tool assemblies for such applications as mining or road milling typically comprise a cutting tool, sometimes referred to as a cutting pick, rotatably mounted within a support block. The support block in turn is mounted onto a drum, chain or other body, typically by welding, which in turn is driven by a suitable drive means. A number of such support blocks carrying cutting tools are mounted onto said drum to continually mine and remove material such as coal, rock, concrete, asphalt or concrete. The material in the earth strata being mined or removed by the cutting tool is pulverized by the cutting picks as each tip is rotated about the drum or chain into contact with the earth strata. The material being mined or removed is pulverized by the impact of the pick and explodes in all directions. Some of the pulverized material collides against the support block and other cutting tool structure. The continual collision of pulverized material against the support block during operation causes abrasion and wear of the support block and any other components mounted on or near the support block.

It is also known to equip a cutting tool assembly with a spray nozzle for spraying fluid onto a cutting tool so as to reduce the potential for ignition of gases encountered during cutting or mining activities. These spray nozzles mounted on cutting tool support blocks are also benefical in suppressing dust particles that otherwise would be stirred up into the atmosphere during the operation of the cutting tool. U.S. Pat. No. 5,378,048, to Parrot, for example, discloses a water spray nozzle that is retained within a threaded bore of a pick box or support block using a resilient retaining ring. This nozzle is relatively complex in design and relatively costly to manufacture. Furthermore, the discharge end of the nozzle is contained within a bore drilled in the support block. Consequently, when the support block is sufficiently worn away, it can no longer house the nozzle; however the support block maintains its usefulness in holding the cutting pick. Despite this the support block and cutting tool assembly must be removed from the drum and a new support block having a new threaded bore for retaining a spray nozzle is attached to the drum. Support blocks are expensive themselves and attaching a new one to a drum is time consuming and disruptive of the mining operation. Typically a replacement support block must be manually welded onto the drum or chain, significantly hampering the efficeiency of the mining operation.

Siebenhofer et al.'s U.S. Pat. No. 5,498,069 discloses a cutting tool assembly including a spray nozzle in a bore of the support block adjacent to the cutting tool. When the support block is sufficiently worn away, it can no longer house the nozzle. Additionally the water passages disposed in Siebenhofer et al.'s support block for providing water to the nozzle are configured such that they cannot be drilled out once the pick support box is welded to a drum. As a result, when the passages become blocked, such as by calcium deposits, the cutting tool assembly is no longer useful for cutting operations that require a functioning spray nozzle.

DISCLOSURE OF THE INVENTION

It is an object of the invention to provide a new and improved cutting tool assembly having a support block and a replaceable spray nozzle housing mounted to the support block, wherein the spray nozzle housing is simple in design and relatively economical to manufacture.

In one embodiment of the invention, the cutting tool assembly comprises a support block having a cylindrical outlet portion. A replaceable unitary spray nozzle housing includes a base and upper spray nozzle housing portion. An inlet body portion extends downward from the base portion. The inlet portion of the replacement nozzle housing includes two separated collars on its exterior surface for forming a press fit seal with the support block cylindrical outlet portion. This press fit seal in combination with a fixing means such as a screw provides a method for quick and easy connection and disconnection of the nozzle housing from the support block.

The cutting tool assembly comprises a support block having first and second outer surfaces and first and second fluid passages. The first and second fluid passages communicate fluid between the first and second outer surface portions of the support block. The first and second fluid passages are in fluid communication with each other at the second outer surface. The replaceable spray nozzle housing inlet body portion is press fit into the bore of first fluid passage at first outer surface such that the spray nozzle housing is in fluid communication with the first fluid passage. The second fluid passage communicates with a conventional nozzle insert positioned near the first outer surface. The first and second passages both have straight-line axes that extend between the second outer surface portion and the first outer surface.

Advantageously, with such a straight-line configuration the first and second fluid passages can each be easily drilled in one machining step during manufacturing. The straight-line passage configurations also permits ease in cleaning debris such as calcium from the fluid passages so as to ensure maximum fluid flow therethrough.

While one embodiment of the new and improved cutting tool assembly is illustrated and disclosed, such disclosure should not be construed to limit the claims. It is anticipated that various modifications and alternative designs may be made without departing from the scope of the invention.

DETAILED DESCRIPTION OF THE INVENTION

Figure 1:
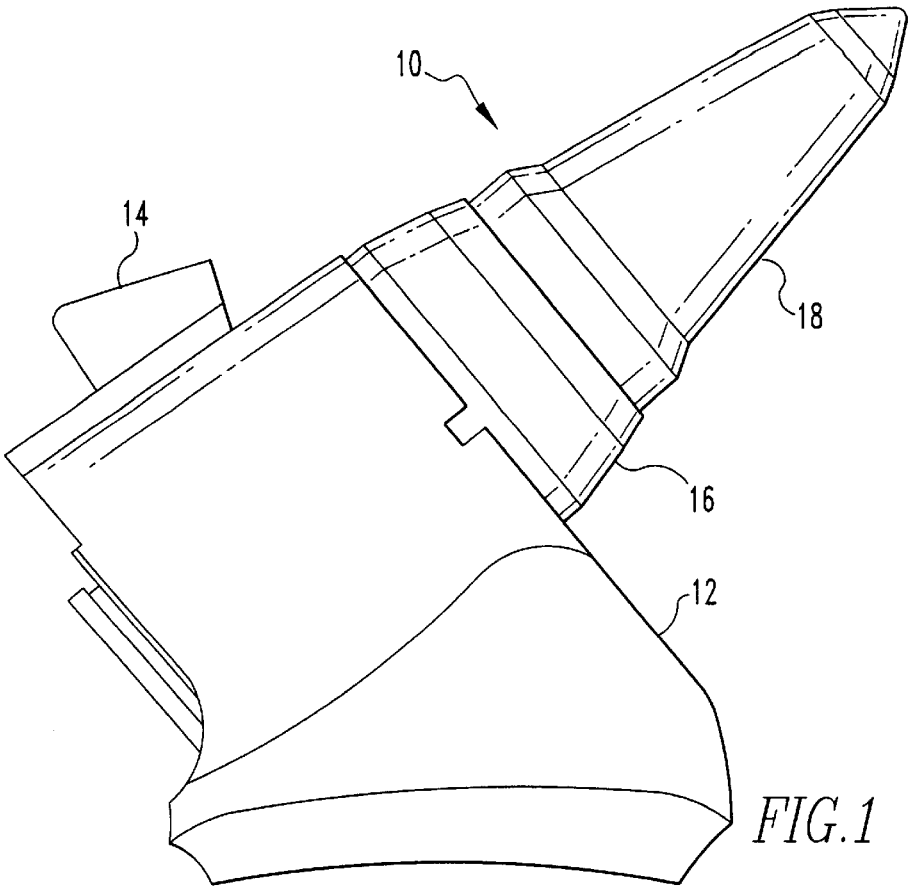
FIG. 1 is a perspective view of a cutting tool assembly showing one embodiment of the invention and including a support block, a replaceable spray nozzle housing, a sleeve and a cutting tool.

FIG. 1 a cutting tool assembly 10 according to the invention for use in mining and cutting operations. The cutting tool assembly 10 includes a support block 12, a replaceable spray nozzle housing 14 removably connected to the support block 12, a protective tool sleeve 16 that is also removably connected to the support block 12, and a cutting tool 18 disposed within the tool sleeve 16.

The support block 12 is adapted to be connected to a rotatable drum (not shown) in any suitable manner, such as by welding, so that the cutting tool 18 may be driven into material sought to be removed or mined. The support block 12 has an exterior that includes first and second outer surface portions 20 and 22, respectively. The first outer surface portion 20 remains exposed during use, while the second outer surface portion 22 is concealed when attached to the housing.

Figure 3:
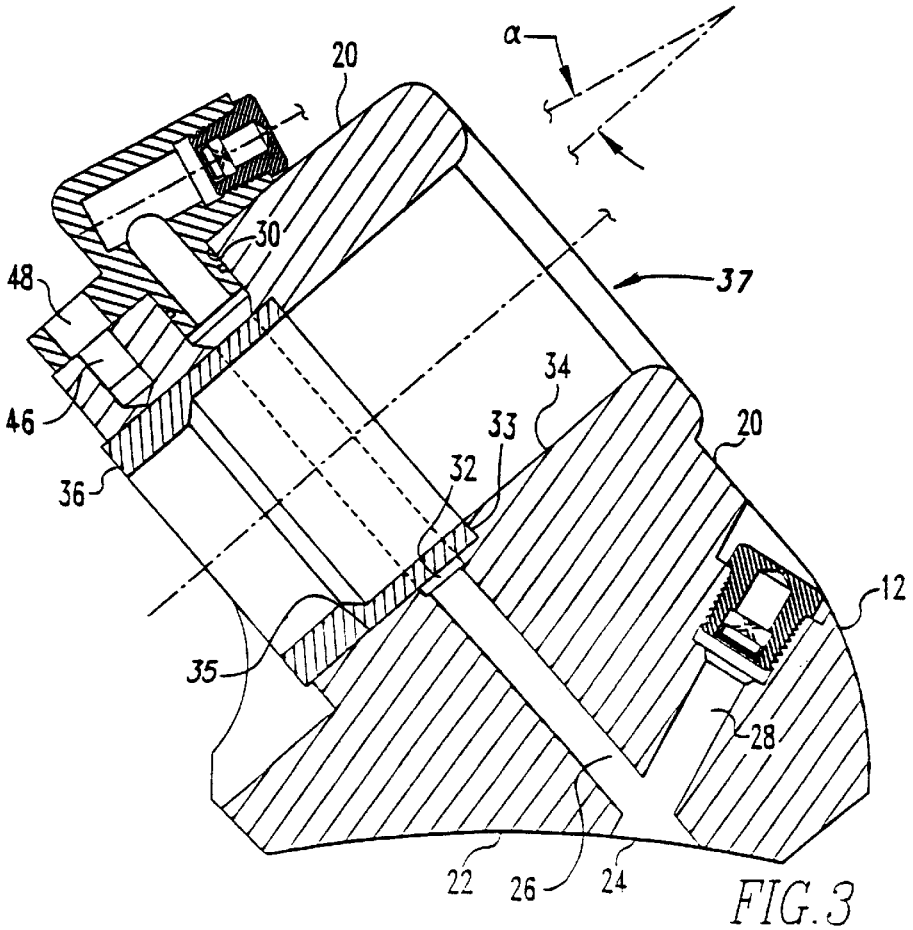
FIG. 3 is a cross-sectional view of the support block of FIG. 2 along lines 3—3.

As shown in FIG. 3, the support block 12 further includes first and second bores 26 and 28. Both bores 26 and 28 are substantially straight and have upstream ends that intersect at the second outer surface portion forming an opening 24.

A first fluid passage is configured to receive the spray nozzle housing 14 in an expanded cylindrical outlet portion 30. The first passage further includes a first annular fluid groove 32 in fluid communication with the outlet portion 30 and the first fluid bore 26.

A protection sleeve holding barrel includes a tapered outlet portion of the support block step bore 34 and a rearward barrel portion defined by the interior of an insert ring 36. The tapered outlet portion of the step bore extends from the end of the insert ring 36 to, the forward opening of the step bore. The insert ring 36 is press fit into a rearward end portion of the support block step bore. The rearward end of the step bore has a larger diameter than the tapered outlet portion of the step bore 34. As best illustrated in FIG. 3, the insert ring 36 which forms the protection sleeve holding rearward barrel portion, has an axial length that is less than about half the overall axial length of the support block step bore 34. The sleeve holding barrel is configured to receive the protective tool sleeve 16.

The insert ring 36 and an annular groove in the support block combine to form a fluid tight annular chamber 32. The first fluid passage extends from fluid bore inlet 24, through bore 26 continuing through annular chamber 32 and communicating with the nozzle housing at an outlet portion 30.

Previously in the prior art seal means such as O-ring seals were required on the outer surface of protective wear sleeves to form a liquid tight annular seal between a liquid supply source and a spray nozzle on the support block. See the seal ring on the protective sleeve in U.S. Pat. No. 4,678,238 to Emmerich. With a separate insert ring element, no seal on the protective sleeve is necessary and the protective sleeve can be designed solely for the purpose of reducing wear on the support block.

The insert ring is press fit into the rearward end 35 of the support block bore. The insert ring abuts against an annular support shoulder 33 formed between the tapered barrel outlet portion 34 and said rearward end. This ring insert has an inner barrel bore portion for receiving the protective tool sleeve and cutting tool. The insert ring is therefore, readily removable from the block bore and can be knocked out manually by a miner or construction worker in the field. Once the insert ring is removed from the support block the first fluid passage can be cleaned out with a drill or some other honing means.

With this type of cutting tool assembly the first and second fluid passages may be easily cleaned. For example, when the spray nozzle housing 14, tool sleeve 16, cutting tool 18 and insert ring 36 are removed from the support block 12, a drill bit (not shown) or other cleaning device may be easily inserted into the fluid bore 26 so as to remove calcium deposits or other debris. To clean the second fluid passage only the nozzle insert 15 must be removed for access to the bore 28. Consequently, the useful life of the cutting tool assembly 10 may be extended significantly beyond normal life expectancies of previous cutting tool assemblies known in the prior art.

Figure 4:
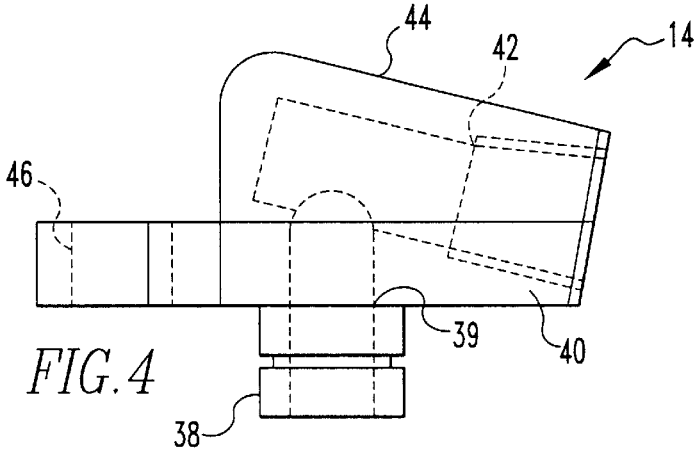
FIG. 4 is a side view of the replacement spray nozzle housing.
Figure 5:
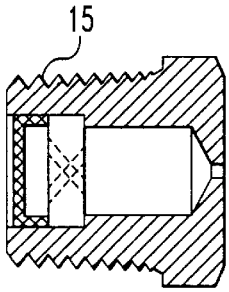
FIG. 5 is a cross-sectional side view of nozzle insert.
Figure 2:
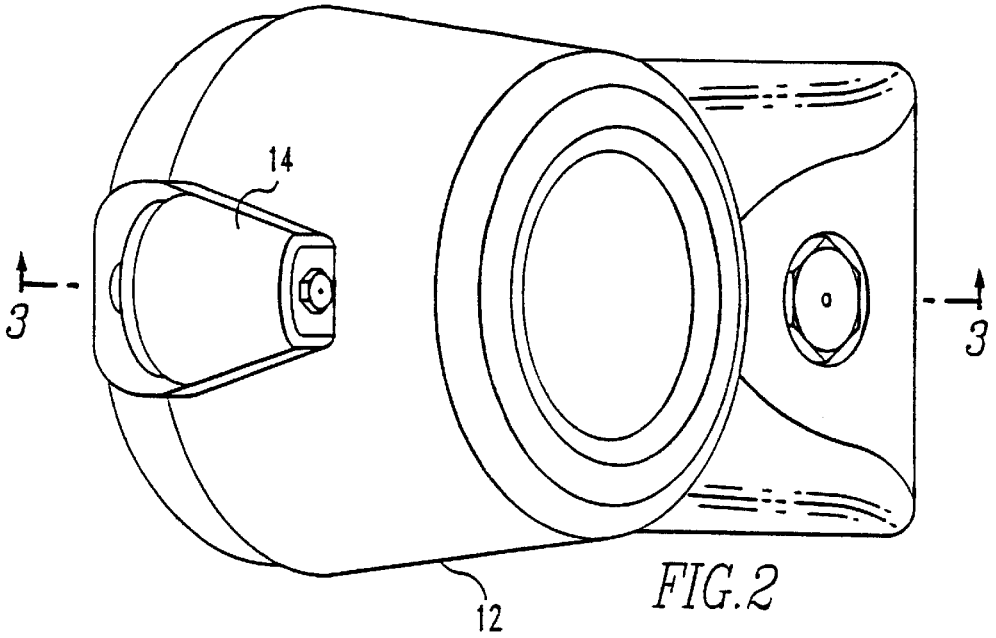
FIG. 2 is a top view of the cutting tool assembly of FIG. 1 with the cutting tool and sleeve removed.

As shown in FIG. 4, the spray nozzle housing 14 of this embodiment includes a unitary body having a cylindrical inlet portion 38, a base 40, and an upper portion 44. The inlet portion 38 has a cylindrical conduit 39 therein and is provided with two press fit collars for providing a liquid tight interference fit with the outlet portion 30 of the first fluid passage. The first outer surface 20 of the support block is provided with an attachment hole 48 adjacent to the outlet portion 30 of the first passage. A screw, bolt, pin, rivet or other suitable fixing means can be inserted in the hole 46 in the base for connecting the nozzle housing base against the support block. The nozzle housing is readily removable from the support block and can be detached by simply removing the screw with a screwdriver and manually knocking out the press fit inlet portion from the support block.

An outlet passage 42 supplying a spray nozzle insert is generally located in the upper portion 44 of the replaceable spray nozzle housing. The axis of the outlet passage 42 forms an angle alpha as shown in FIG. 3 of about 14 (degrees) with respect to the central axis of the block bore 37. The water spray from the nozzle insert is projected in the direction of the cutting tool tip.

To assemble the cutting tool assembly 10, the support block 12 is welded to a rotatable drum (not shown) so that the first and second fluid passages are in fluid communication with a fluid supply passage (not shown) in the drum. The weld sufficiently seals the support block 12 to the drum in a liquid tight manner. An insert ring 36 is positioned in the support block. The protection sleeve 16 is then inserted in the barrel of the support body. The cutting tool 18 is then inserted into the tool sleeve 16 and secured to the tool sleeve 16 in any suitable manner such as a retainer ring. Next, the spray nozzle housing 14 is inserted into the expanded outlet portion 30 of the first flow passage in the support block and then secured in position by a screw (or any other well-known fastening means in the art). The nozzle insert 15 is then coupled to the second passage in a liquid tight manner.

In operation of the cutting tool assembly 10, a supply manifold in the drum communicates water to inlet 24. Inlet 24 communicates with first and second fluid bores 26/28. The water in the first passage flows through bore 26 into annular chamber 32, in and out of the spray nozzle insert 15 and toward the tip of the cutting tool 18. Water in the second passage flows through bore 28 and exits nozzle insert 15 toward the cutting tip. The water from both nozzle inserts reduces the potential for ignition of gases such as methane encountered during cutting or mining activities. The water spray additionally suppresses dust during mining and also helps to lubricate the joint between the cutting tool and sleeve for better rotation of the cutting tool.

While an embodiment of the invention has been illustrated and described, it is not intended that this embodiment illustrates and describes all possible forms of the invention. Rather, the words used in the specification are words of description rather than limitation, and it is understood that various changes may be made without departing from the spirit and scope of the invention.

What is claimed is:

1. A cutting tool assembly comprising:

a support block to be secured to a moving element of a mining machine, said support block having a block bore with a tapered barrel outlet portion and a rearward end; and an insert ring fixed into said rearward end of said block bore;

a replaceable spray nozzle housing mounted on said support block;

a first fluid passage located in said support block wherein said replaceable nozzle housing is in fluid communication with said first fluid passage wherein said insert ring and said block bore have a common central axis, said insert ring has an axial length that is less than about half the overall axial length of the support block bore.

2. The cutting tool assembly according to claim 1, wherein said support block has an annular groove, said annular groove cooperates with an outer surface of said ring insert to form an annular chamber, wherein said first fluid passage comprises said annular chamber.

3. The cutting tool assembly according to claim 1, wherein the support block has a first outer surface and a second outer surface, wherein the first fluid passage communicates fluid between said first outer surface and said second outer surface.

4. The cutting tool assembly according to claim 3, wherein said replaceable nozzle housing is fixed to said first outer surface.

5. The cutting tool assembly according to claim 3, wherein said first fluid passage is substantially straight between said first and second outer surfaces so as to permit a drill to be inserted into said first fluid passage for cleaning.

6. The cutting tool assembly according to claim 5, wherein said replaceable nozzle housing is removably connected to said support block so as to permit cleaning access to said first fluid passage.

7. The cutting tool assembly according to claim 1, wherein said insert ring has an inner barrel bore portion for receiving said cutting tool.

8. The cutting tool assembly according to claim 1, wherein said block bore generally having a tapered holding barrel portion and a rearward end, an annular support shoulder between the said outer barrel portion and said rearward end said ring insert is press fit into said rearward end of said block bore, said ring insert being easily removed from said support block in the field to permit cleaning of said first fluid passage.

9. The cutting tool assembly according to claim 8, wherein said insert is a concentric annular insert ring.

10. The cutting tool assembly according to claim 9, wherein said annular insert ring forms a rearward holding barrel portion.

11. The cutting tool assembly according to claim 10, further comprising:

a protective sleeve, said protective sleeve is positioned in said rearward and tapered holding barrel portions.

12. The cutting tool assembly according to claim 11, further comprising:

a cutting tool, said cutting tool extends through said protective sleeve.

13. A block for a cutting tool assembly, said block comprising: a block to be secured to a moving element of a mining machine wherein the support block has a first outer surface and a second outer surface, wherein a first fluid passage communicates fluid between said outer surface and said second outer surface;

said support block having a block bore with an outlet end to be adjacent the working end of a cutting tool, wherein said first fluid passage is substantially straight from said first outer surface to said second outer surface so as to permit a drill to be inserted into said first fluid passage for cleaning.

14. The cutting tool assembly according to claim 13, further comprising:

a replaceable spray nozzle housing including a unitary housing, wherein said replaceable nozzle housing is in fluid communication with said first fluid passage.

15. The cutting tool assembly according to claim 13, wherein said support block bore has an annular groove.

16. The cutting tool assembly according to claim 15, wherein said annular groove cooperates with an outer surface of an insert ring to form an annular chamber.

17. The cutting tool assembly according to claim 13, wherein said support body comprises a second fluid passage between said first and second outer surfaces.

18. The cutting tool assembly according to claim 17, wherein the second outer surface is concealed when the support block is connected to said moving element.

19. The cutting tool assembly according to claim 17, wherein said second fluid passage is substantially straight between said first and second outer surfaces so as to permit a drill to be inserted into said first fluid passage for cleaning.

20. The cutting tool assembly according to claim 19, wherein the first fluid passage and second fluid passage intersect adjacent said second outer surface.

21. The cutting tool assembly according to claim 19, wherein the second outer surface is concealed when the support block is connected to said moving element.

22. A cutting tool assembly comprising: a replaceable unitary spray nozzle housing connected to a support block by a liquid tight double interference fit; wherein said replaceable unitary spray housing includes an upper portion and an inlet portion, said upper portion has an outlet passage having a longitudinal axis in communication with a cylindrical conduit in said inlet portion.

23. A cutting tool spray nozzle housing for connection to a holder block comprising:

an upper portion and an inlet portion, wherein said inlet portion has a liquid tight double interference fit.

24. The cutting tool spray nozzle housing according to claim 23, wherein said upper portion comprises an outlet passage having a longitudinal axis in communication with a cylindrical conduit in said inlet portion.

25. The cutting tool assembly according to claim 24, further comprising:

a fixing means for connecting said nozzle housing to said support block.

26. A cutting tool assembly comprising:

a support block to be secured to a moving element of a mining machine, said support block having a block bore with a tapered barrel outlet end to be adjacent the working end of a cutting tool; and an insert ring fixed into said block bore;

a protection sleeve inserted in said block bore.

27. The cutting tool assembly according to claim 26, further comprising:

a replaceable spray nozzle housing mounted on said support block; and a first fluid passage located in said support block wherein said replaceable nozzle housing is in fluid communication with said first fluid passage.

28. The cutting tool assembly according to claim 26, wherein the support block has a first outer surface and a second outer surface, wherein a first fluid passage communicates fluid between said first outer surface and said second outer surface;

wherein said first fluid passage is substantially straight between said first and second outer surfaces so as to permit a drill to be inserted into said first fluid passage for cleaning.

29. A cutting tool assembly comprising:

a support block to be secured to a moving element of a mining machine, said support block having a block bore with a tapered end to be adjacent the working end of a cutting tool; and an insert ring fixed into said rearward end of said block bore;

a replaceable spray nozzle housing mounted on said support block;

a first fluid passage located in said support block wherein said replaceable nozzle housing is in fluid communication with said first fluid passage wherein said block bore generally having a tapered holding barrel portion and a rearward end, an annular support shoulder between said outer barrel portion and said rearward end, said ring insert is press fit into said rearward end of said block bore, said ring insert being easily removed from said support block in the field to permit cleaning of said first fluid passage.

30. A block for a cutting tool assembly, said block comprising:

a block to be secured to a moving element of a mining machine wherein the support block has a first outer surface and a second outer surface, wherein a first fluid passage and a second fluid passage communicate fluid between said first outer surface and said second outer surface;

said block having a block bore with an outlet end to be adjacent the working end of a cutting tool, wherein said first fluid and said second fluid passages are substantially straight from said first outer surface to said second outer surface so as to permit a drill to be inserted into said first fluid passage for cleaning, wherein the first fluid passage and second fluid passage intersect adjacent said second outer surface.

31. A cutting tool assembly having a protection sleeve holding barrel comprising:

a support block, and a protection tool sleeve, said support block having a block bore with a tapered outlet portion, wherein said protection sleeve holding barrel comprises said tapered outlet portion and a rearward barrel portion, said rearward barrel portion formed by an insert ring fixed to said block bore;

wherein said protective tool sleeve is inserted inside said protection sleeve holding barrel.

32. The cutting tool assembly according to claim 31 further comprising:

a replaceable spray nozzle housing mounted on said support block; and a first fluid passage located in said support block wherein said replaceable nozzle housing is in fluid communication with said first fluid passage.

33. The cutting tool assembly according to claim 32, wherein the support block has a first outer surface and a second outer surface, wherein said first fluid passage communicates fluid between said first outer surface and said second outer surface;

wherein said first fluid passage is substantially straight between said first and second outer surfaces so as to permit a drill to be inserted into said first fluid passage for cleaning.

34. The cutting tool assembly according to claim 33, wherein said insert ring is press fit into said block bore.

* * * * *